US005331879A

United States Patent [19]

Löffler

[11] Patent Number: 5,331,879

[45] Date of Patent: Jul. 26, 1994

[54] ELECTROTHERMAL FIRING DEVICE AND CARTOUCHE FOR USE IN SUCH DEVICES

[75] Inventor: Markus Löffler, Unterluss, Fed. Rep. of Germany

[73] Assignee: TZN Forschungs-und Entwicklungszentrum Unterluss GmbH, Unterlüss, Fed. Rep. of Germany

[21] Appl. No.: 955,023

[22] Filed: Oct. 1, 1992

[30] Foreign Application Priority Data

Oct. 1, 1991 [DE] Fed. Rep. of Germany ..... 4132657

[51] Int. Cl.[5] ..... F41B 6/00

[52] U.S. Cl. ..... 89/8; 124/3; 102/467; 102/472

[58] Field of Search ..... 89/8; 102/202.7, 202.8, 102/472, 466, 467; 124/3

[56] References Cited

U.S. PATENT DOCUMENTS

| | | | |
|---|---|---|---|
| 667,435 | 2/1901 | Friese-Greene | 89/8 |
| 3,267,720 | 8/1966 | Escallier et al. | 89/8 |
| 4,711,154 | 12/1987 | Chryssomallis et al. | 89/7 |
| 4,907,487 | 3/1990 | Tidman et al. | 89/8 |
| 4,957,035 | 9/1990 | Eskam et al. | 89/8 |
| 4,967,737 | 11/1990 | Bassett et al. | 128/25 B |
| 5,115,743 | 5/1992 | Löffler | 102/472 |

FOREIGN PATENT DOCUMENTS

| | | |
|---|---|---|
| 0242501 | 1/1987 | European Pat. Off. . |
| 0220556 | 5/1987 | European Pat. Off. . |
| 0232594 | 8/1987 | European Pat. Off. . |
| 3816300 | 11/1989 | Fed. Rep. of Germany . |
| 3613259 | 12/1989 | Fed. Rep. of Germany . |
| 2217820A | 1/1989 | United Kingdom . |
| 2217821A | 11/1989 | United Kingdom . |
| 229799A | 3/1990 | United Kingdom . |

*Primary Examiner*—Stephen C. Bentley
*Attorney, Agent, or Firm*—Spencer, Frank & Schneider

[57] ABSTRACT

An electrothermal firing device (1) including a tube containing a charge chamber (4') in which a first electrode (9) is disposed at the end of the charge chamber (4') adjacent the breechblock (2) and a second electrode (10) is disposed at the end of the charge chamber adjacent the projectile (6). To permit the first electrode (9) adjacent the breechblock to be arranged in the charge chamber without expensive supports, in contrast to such prior art devices, this first electrode (9) is configured as the grounded electrode and the second electrode (10) is configured as the high voltage electrode. Preferably, the two electrodes (9, 10) are arranged in an exchangeable cartouche (18) so that conventional charge chambers employing corresponding loading devices can be retrofitted in a simple manner for use with electrothermal firing devices (1).

8 Claims, 1 Drawing Sheet

ELECTROTHERMAL FIRING DEVICE AND CARTOUCHE FOR USE IN SUCH DEVICES

BACKGROUND OF THE INVENTION

The present invention relates to an electrothermal firing device including a breechblock and a tube provided with a charge chamber and a projectile path portion or barrel, and wherein first and second electrodes, which are separated from one another by a sleeve of an electrically insulating material, are disposed in the charge chamber at the respective ends thereof. The invention further relates to a cartouche or cartridge for use in such electrothermal firing devices.

Electrothermal firing devices are disclosed, for example, in Unexamined Published German Patent Applications DE 3,613,259.A1 and DE 3,816,300.A1. A significant component of such devices is the combustion chamber (charge chamber) in which, with the aid of an electric arc of a high arc voltage (e.g., 30 kV) through which flows a high current (e.g., 400 kA), suitable substances are heated and converted to the gaseous state (plasma). Pressures up to 1 GPa are generated thereby. Finally, the gases under these high pressures are employed to accelerate projectiles in a tubular weapon.

In the prior art electrothermal firing devices, two axially displaced electrodes are disposed in the charge chamber, with the first electrode being brought coaxially through the breechblock of the firing device and being configured as a high voltage electrode. The second electrode is disposed adjacent the projectile and is connected to ground. Such an electrode arrangement permits easy contacting with the grounded tube or barrel of the weapon in the region of the second electrode, while the first high voltage electrode, which is under considerably more mechanical stress, must be supported in an extremely expensive manner. The reason for this is that the first electrode is wrapped in insulating material to insulate it against the breechblock and the generated forces must be supported by this insulating material. Moreover, loading the projectile and a cartouche or cartridge including the electrodes into the firing devices is difficult since the high voltage electrode must be brought through the breechblock. Thus, the breechblocks of conventional guns cannot be employed with the prior art electrothermal firing devices.

SUMMARY OF THE INVENTION

It is an object of the present invention to further develop an electrothermal firing device of the above initially described type so that the electrode adjacent the breechblock can also be disposed in the charge chamber without expensive supports and is able to withstand high pressures.

The above object generally is achieved according to the invention by an electrothermal firing device comprising: a tube including a charge chamber containing portion, and a projectile path portion connected to the charge chamber containing portion and coaxial with the charge chamber; a breechblock for closing a breech end of the charge chamber; a first grounded electrode disposed in the charge chamber at the breech end; a second high voltage electrode disposed in the charge chamber at its end adjacent the projectile path portion; and a sleeve of an electrically insulating material disposed in the charge chamber between the electrodes and separating the electrodes from one another.

According to features of the invention, insulation is provided to electrically insulate the second electrode i.e. the high voltage electrode, from at least the charge chamber containing portion of the tube, electrical insulation is likewise provided to electrically insulate the charge chamber containing portion from the projectile path portion of the tube, and the projectile path portion of the tube is at least partially conductively connected with the high voltage electrode.

According to still further features of the invention an electrically insulating coating is disposed on the exterior surface of the projectile path portion of the tube, the first (grounded) electrode is a disc mounted at one end of the sleeve and the second (high voltage) electrode is a ring electrode mounted at least partially in an inner surface of the sleeve at its opposite end.

The invention is thus essentially based on the concept that the high voltage electrode should not be brought through the breechblock as in the prior art firing devices, but instead the high voltage should be applied to the electrode which is adjacent the projectile.

It is particularly advantageous if both electrodes are arranged in an exchangeable cartouche because then it is possible to retrofit conventional guns into electrothermal firing devices at relatively little expense, and primarily to also permit employment of conventional loading devices for electrothermally accelerated projectile arrangements.

Thus, according to a further feature of the invention, a cartouche for an electrothermal firing device according to the invention includes first and second spaced electrodes mounted at opposite ends of a sleeve of an electrically insulating material. Preferably, the first electrode is a disc mounted in the sleeve at one end thereof, and the second electrode is a ring electrode mounted at least partially in an inner surface of the sleeve at its opposite end. For cartridged ammunition, a projectile has its rear end mounted in the ring electrode.

Further details and advantages of the invention will be described with reference to embodiments thereof and with the aid of the drawing figures.

DETAILED DESCRIPTION OF THE PREFERRED EMBODIMENTS

Figure 1:
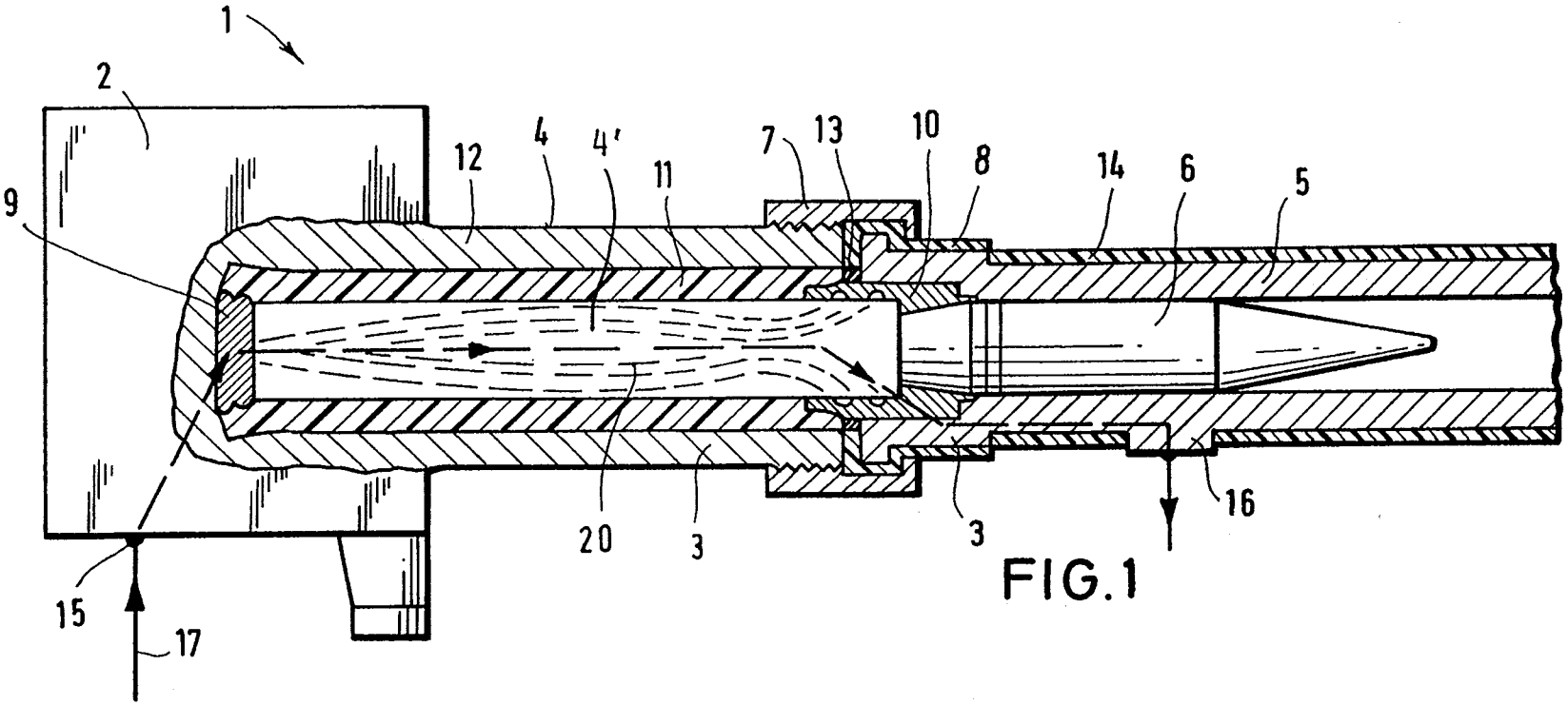
FIG. 1 shows the portion of a firing device according to the invention adjacent the breechblock during the formation of a plasma in the charge chamber.

In FIG. 1, the reference numeral 1 identifies an electrothermal firing device essentially composed of a conventional breechblock 2 that is indicated only schematically and a metal tube or gun barrel 3. Tube 3 is composed of a charge chamber containing portion 4 at its breech end and a coaxial projectile path portion 5 in which a projectile 6 is disposed. Projectile path portion 5 is screwed to charge chamber portion 4 by means of a coupling ring 7 or by a flange connection (not shown). A sleeve 8 of insulating material is provided around the end of the projectile path portion 5, including its end surface, to electrically insulate charge chamber portion 4 and projectile path portion 5 from one another.

At its end facing the breechblock, charge chamber 4' accommodates a first electrode 9 which is electrically connected with breechblock 2 when closed, and is grounded. At the end of charge chamber 4' adjacent projectile path portion 5, a second electrode 10 is disposed to which the high voltage is applied and which, in the illustrated embodiment, is connected in an electrically conductive manner with projectile path portion 5. The second electrode 10 is advantageously an annular or ring electrode as shown. Both electrodes 9 and 10 are physically and electrically separated from one another by a sleeve 11 made, for example, of plastic. Additionally, a high voltage seal 13 of rubber or silicone rubber is disposed around the electrode 10 so that it is effectively inserted between the second electrode 10 and charge chamber wall 12 in order to obtain a continuous insulation path. When charge chamber containing portion 4 and projectile path portion 5 are assembled, this seal 13 must be put under so much pressure that no slits or gaps are able to develop in order to prevent a discharge between the electrode 10 and the edge surface of the wall portion 12.

The projectile path portion 5 which is electrically connected with the second electrode 10 is provided over its entire length with an electrically insulating coating 14, for example, a heat-shrinkable tubing. Heat-shrinkable tubing 14 may be metalized on its exterior. In that case, the metallization is connected to ground.

The electrothermal firing device 1 is supplied with current on the ground side via a terminal 15 for the breechblock 2, and on the high voltage side via a terminal 16 for projectile path portion 5. The corresponding current path, once a plasma 20 has formed, is shown in dashed lines within the firing device and is given the reference numeral 17.

As already mentioned above, electrodes 9 and 10 and sleeve 11 are preferably disposed in an exchangeable unit or cartouche so that a new cartouche is loaded with each projectile 6. The loading process may employ cartridged or separate ammunition as this is the case in conventional anti-tank guns or howitzers.

Figure 2:
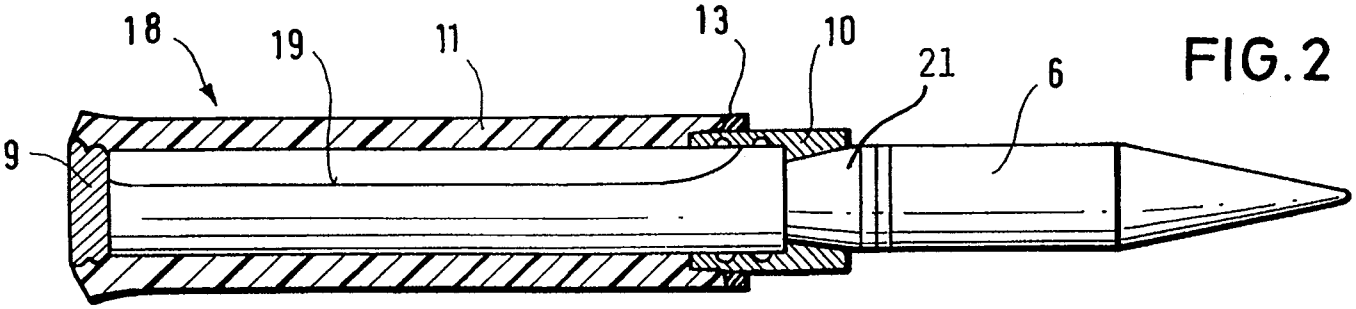
FIG. 2 shows a separate cartridge according to the invention containing the two electrodes together with the projectile.

FIG. 2 shows such a cartouche 18 in which the rear end 21 of the projectile 6 is surrounded by the second electrode 10 (i.e., a cartridged configuration). The electrode 9, as shown in FIG. 2, is a disc which is mounted and secured in the open breech end of the sleeve 11 and the ring or annular electrode 10 is mounted at the other end of the sleeve 11 and at least partially in the inner surface of sleeve 11. The electrode 10 extends beyond the end of the sleeve 11 so that it can, in the illustrated embodiment, extend into the barrel or projectile path portion 5 and electrically contact same. Moreover, particularly if the unit 18 is to be used in a complete cartridge configuration as shown, at least a forward portion of the interior surface of the annular electrode 10 is given a taper which matingly engages the tapered rear end 21 of the projectile 6 in order to support same.

As further shown in FIG. 2, the cartouche 18 includes a metal filament 19 which is fastened between the two electrodes 9 and 10. As soon as the high voltage is applied to electrodes 9 and 10, this metal filament 19 immediately evaporates and forms a plasma 20 (FIG. 1) that is heated by the current flowing through it and serves to drive projectile 6. The remaining volume of the cartouche 18 may be filled with a further material (not shown) suitable for driving the projectile. Suitable materials are disclosed in the two above-mentioned publications. Conventional powders may also be employed.

The invention now being fully described, it will be apparent to one of ordinary skill in the art that any changes and modifications can be made thereto without departing from the spirit or scope of the invention as set forth herein.

What is claimed is:

1. An electrothermal firing device comprising: a tube including a charge chamber containing portion and a projectile path portion connected to the charge chamber containing portion and coaxial with the charge chamber; a breechblock for closing a breech end of the charge chamber; a first grounded electrode disposed in said charge chamber at said breech end; a second high voltage electrode disposed in said charge chamber at its end adjacent said projectile path portion; a sleeve of an electrically insulating material disposed in said charge chamber between said electrodes and separating said electrodes from one another; means for electrically insulating said second electrode from at least said charge chamber containing portion of said tube; and further electrical insulating means for electrically insulating said charge chamber containing portion from said projectile path portion of said tube.

2. An electrothermal firing device as defines in claim 1, wherein said projectile path portion of said tube is at least partially conductively connected with said second electrode.

3. An electrothermal firing device as defined in claim 2, further comprising an electrically insulating coating disposed on the exterior surface of said projectile path portion.

4. An electrothermal firing device as defined in claim 1, wherein said second electrode is a ring electrode.

5. An electrothermal firing device as defined in claim 4, wherein said first electrode is a disc mounted at one end of said sleeve and said ring electrode is mounted at least partially in an inner surface of said sleeve at its opposite end.

6. An electrothermal firing device as defined in claim 1, wherein said first and second electrodes and said sleeve are connected together as an exchangeable unit.

7. A cartouche for use in an electrothermal firing device including a tube provided with a charge chamber containing portion and a coaxial projectile path portion, and a breechblock for closing a breech end of the charge chamber, said cartouche comprising: first and second spaced electrodes mounted on a sleeve of an electrically insulating material at opposite ends thereof, with said first electrode being a disc mounted in said sleeve at one end thereof, and said second electrode being a ring electrode mounted at least partially in an inner surface of said sleeve at its opposite end; and, a projectile having its rear end mounted in said ring electrode.

8. A cartouche as defined in claim 7, further comprising a metal filament disposed in said sleeve and connected between said first and second electrodes.

* * * * *